United States Patent [19]

Chan et al.

[11] Patent Number: 5,009,728

[45] Date of Patent: Apr. 23, 1991

[54] CASTABLE, INSENSITIVE ENERGETIC COMPOSITIONS

[75] Inventors: May L. Chan; Alan D. Turner, both of Ridgecrest, Calif.

[73] Assignee: The United States of America as represented by the Secretary of the Navy, Washington, D.C.

[21] Appl. No.: 464,076

[22] Filed: Jan. 12, 1990

[51] Int. Cl.[5] ..... C06B 45/10

[52] U.S. Cl. ..... 149/19.1; 149/19.4; 149/19.5; 149/19.6; 149/19.9; 149/19.91; 149/88; 149/92

[58] Field of Search ..... 149/19.4, 19.6, 19.9, 149/19.91, 19.1, 19.5, 88, 92

[56] References Cited

U.S. PATENT DOCUMENTS

| | | | |
|---|---|---|---|
| 3,389,026 | 7/1968 | Johnson | 149/19 |
| 3,480,490 | 11/1969 | Finger et al. | 149/92 |
| 3,501,357 | 3/1970 | Suzuki et al. | 149/19.9 |
| 3,778,319 | 12/1973 | Benziger | 149/92 |
| 3,878,003 | 4/1975 | Lo Presti et al. | 149/19.8 |
| 3,879,504 | 4/1975 | Sherman et al. | 264/3 |
| 3,932,241 | 1/1976 | Sayles | 149/19.91 |
| 3,943,209 | 3/1976 | Lo Presti et al. | 149/92 |
| 3,953,258 | 4/1976 | Sayles | 149/19.91 |
| 3,959,042 | 5/1976 | McCulloch et al. | 149/19.92 |
| 4,141,768 | 2/1979 | Lo et al. | 149/19.6 |
| 4,141,910 | 2/1979 | Flanagan et al. | 149/88 |
| 4,325,759 | 4/1982 | Voigt et al. | 149/19.92 |
| 4,361,526 | 11/1982 | Allen | 264/3 |
| 4,393,199 | 7/1983 | Manser | 149/19.6 |
| 4,426,540 | 1/1984 | Shackelford et al. | 149/19.91 |
| 4,456,494 | 6/1984 | Maes et al. | 149/21 |
| 4,555,277 | 11/1985 | Scribner | 149/19.4 |
| 4,632,714 | 12/1986 | Abegg et al. | 149/2 |
| 4,764,316 | 8/1988 | Brown et al. | 264/3.1 |
| 4,806,613 | 2/1989 | Wardle | 149/19.6 |
| 4,889,571 | 12/1989 | Willer et al. | 149/19.9 |

OTHER PUBLICATIONS

P. A. Mancinelli and S. O. Norris, "Macromonomers Lead to Acrylic Hot Melt and Solvent PSAs", reprint from Adhesives Age, Sep. 1985, (copy enclosed).

*Primary Examiner*—Edward A. Miller

*Attorney, Agent, or Firm*—Donald E. Lincoln; Melvin J. Sliwka; Sol Sheinbein

[57] ABSTRACT

Energetic materials exhibiting low sensitivity comprise a solid solution of nitroaliphatic oxidizer, preferably trinitroethyl derivatives, in plasticized thermoplastic elastomer such as a block copolymer of polystyrene and polyacrylate plasticized with dioctyl adipate. The energetic material is prepared by forming molten plasticized elastomer and then incrementally dissolving the oxidizer in the molten binder.

16 Claims, No Drawings

CASTABLE, INSENSITIVE ENERGETIC COMPOSITIONS

Descripiton

1. Technical Field

This invention relates to a castable, insensitive, energetic composition and, more particularly, the present invention to a homogeneous energetic composition having minimum or no crystalline solid phase.

2. Background of the Invention

Existing castable, insensitive, energetic compositions generally have two distinct physical phases—a continuous phase consisting of a soft, rubbery binder and a discontinuous phase consisting of a hard crystalline explosive solid dispersed throughout the binder. Upon shock or mechanical loading, separation or dewetting of the binder and solid can easily occur causing a significant increase in sensitivity and a resulting increase in undesirable hazard properties.

Amorphous-type energetic compositions and emulsion-type energetic compositions have been developed to avoid the phase separation problem. Known amorphous energetic compositions are characterized by a single phase in which a polynitroaliphatic energetic solid is completely dissolved in a nitropolymer fuel to form a soft, jelly-like material. Although amorphous-type compositions exhibit little or no crystal character under X-ray diffraction, they are impact sensitive and have undesirable mechanical properties for most energetic material applications. Emulsion-type energetic compositions are characterized as a solid solution in which a solid crystalline explosive phase is dispersed in a continuous solid binder phase. Ammonium Nitrate (AN) emulsion-type compositions are prepared by mixing an immiscible molten AN and molten binder with an emulsifier to form a stable emulsion which becomes solid upon cooling. Only limited numbers of AN eutectic mixtures melt at temperatures low enough to be useful, thus limiting the energy level of the resulting composition. Additionally, vigorous mechanical agitation is necessary to form the emulsion. The combination of high temperatures and vigorous mechanical agitation of a molten explosive always creates some concern for safety during processing.

Thermoplastic elastomers (TPE) are desirable as binders for composite propellants due to their ability to form composite propellants without chemical cross linking. Crosslinked propellants cannot be redissolved. Furthermore, they tend to become brittle with age. The TPE binders are soluble, permitting lowering viscosity of the polymer in solution. Oxidizer salts can be dispersed in the binder at lower energy and lower temperature. Furthermore, waste and obsolete propellant can be safely returned to its components by remelting rather than requiring burning or explosion to dispose of the material.

STATEMENT OF THE PRIOR ART

An example of solution dispersion of inorganic oxidizer in a solution of TPE binder is disclosed in U.S. Pat. No. 4,361,526. The composite propellant can be recovered by solution. However, use of solvent is undesirable for health and environmental reasons.

A composite propellant in which organic oxidizer such as ammonium perchlorate (AP) and a nitramine such as RDX or HMX is dispersed in a bulk polybutadiene based thermoplastic binder is disclosed in U.S. Pat. No. 4,764,316. The bulk mixture is zone heated inside a cavity to form a solid propellant grain. This process eliminates solvent. However, the solid grains produced by both of these patents have two phases and are shock sensitive.

Maes et al. in U.S. Pat. No. 4,456,494 discloses a blasting composition including inorganic nitrate oxidizer and a gelling agent formed from an aqueous slurry. U.S. Pat. No. 3,389,026 discloses a plasticized explosive composition containing dissolved or colloided polynitroaliphatic oxidizer (lines 10–18 of col. 2), a nitropolymeric fuel and a plasticizer. McCulloch et al. in U.S. Pat. No. 3,959,042 discloses a gun propellant composition formed by dispersing a polynitramine such as RDX or HMX into an organic solution of a saturated polymer followed by precipitation. Sherman et al. in U.S. Pat. No. 3,879,504 disclose an injection molded nitramine containing propellent formed from a mixture of fine powder, oil or liquid elastomer and a catalyst.

Abegg et al. discloses a solid energetic composition containing a thermoplastic elastomer. However, the fuel is emulsified by means of surfactants to disperse the molten oxidizer into discrete oxidizer cells. Eutectic mixtures of oxidizer salts are utilized to lower the temperature.

STATEMENT OF THE INVENTION

It has been discovered according to the present invention that energetic materials exhibiting a low degree of sensitivity can be prepared from thermoplastic elastomers and nitroaliphatic oxidizers. Thermoplastic elastomers containing polar segments and thermoplastic elastomers plasticized with oxygenated plasticizers have been found to dissolve or substantially dissolve certain polynitroaliphatic energetic solids in a manner which inhibits extensive recrystallization upon cooling. The resulting energetic material is homogeneous or amorphous in appearance and exhibits a high degree of insensitivity to external stimuli.

Thermoplastic elastomers (TPEs) are used as binder material. The TPEs are heated and mixed with plasticizers and a polynitroaliphatic oxidizer to form a true molten solution of oxidizer and binder during processing. The TPE must be compatible with the oxidizer and oxygenated plasticizer to form a miscible solution at elevated temperatures.

The energetic materials of the present invention have a homogeneous state which provides a high degree of insensitivity to external stimuli. The novel energetic materials of the invention have the advantage of being ballistically tailorable for applications such as rocket propellants, gun propellants and explosives while still maintaining a high degree of insensitivity to external stimuli.

The formulations of the present invention show particular advantage as rocket propellants because the materials have a very high combustion efficiency and a high degree of insensitivity. The high combustion efficiency results from intimate contact between the fuel and oxidizer in the homogeneous state.

These and many other features and attendant advantages of the inventions will become apparent as the description proceeds.

DETAILED DESCRIPTIONS OF THE INVENTION

The TPE can be a saturated hydrocarbon polymer such as polyethylene, polypropylene, polyisobutylene, or polystyrene, an unsaturated polymer such as polybutadiene or polyisoprene or a hydrocarbon polymer containing polar segments such as a polyester, polyether or a polyurethane. There is higher compatibility and solubility between the TPE and the nitroaliphatic oxidizer when the TPE or the plasticizer includes oxygen containing polar segments. The oxygenated plasticizers are usually $C_1$ to $C_{10}$ alkyl esters of aliphatic or aromatic hydrocarbon acids. The plasticized TPE contains at least 50% by weight plasticizer usually at least to 60% by weight plasticizer, preferably from 70 to 90% by weight.

Suitable TPEs include thermoplastic polyesters, polyethylenes, polystyrenes; polyethers and the following block copolymers:

styrene-isoprene-styrene block copolymer;
styrene-ethylene/butylene-styrene block copolymer;
polystyrene-polyacrylate copolymer;
ethylene-vinylacetate copolymer;
polyacrylate-isoprene copolymer; and
vinylacetate-aliphatic polyester copolymer.

The thermoplastic elastomers are graft copolymers of a prepolymerized macromonomer segment terminating in a polymerizable end group suoh as a vinyl group and a monomer. This results in a linear, comb-type copolymer of the monomer and the vinyl group of the macromonomer having side chains of the prepolymer pendant from the backbone of the copolymer. There is wide versatility in the control of the properties of the resulting thermoplastic elastomer. The backbone can have polar properties while the side chains can be oleophilic hydrocarbon or vice versa.

The macromonomer usually has a molecular weight from 500 to about 50,000 usually about 5,000 to 25,000. Representative macromonomers are styrene-isoprene copolymer, styrene-ethylene copolymer polystyrene ethylene, polyacrylate and polyvinyl acetate.

The polymerizable comonomer can be styrene, butylenestyrene, acrylate, vinyl acetate, isoprene or polyester. The macromonomer is end capped with a group copolymerizable with the monomer, usually of the same type. For example, the polystyrene macromonomer terminates in an acrylate group when copolymerized with a vinyl-containing monomer, usually of the same type. For example, the polystyrene macromonomer terminates in an acrylate group when copolymerized with an acrylate comonomer.

Styrene-acrylate TPE based on acrylate modified polystyrene macromonomers are disclosed in U.S. Pat. No. 3,786,116, the disclosure of which is incorporated herein by reference. These materials have been commercially utilized in solvent based and hot melt pressure sensitive adhesives.

The styrene/acrylate (SA) TPE can be represented as follows:

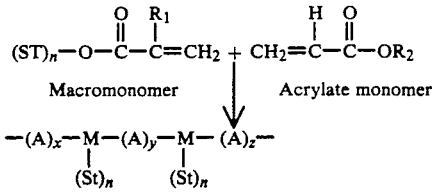

where n is an integer such that the molecular weight of the macromonomer is from 500 to 50,000, $R_1$ is H or alkyl of 1-6 carbon atoms, $R_2$ is alkyl of 1-6 carbon atoms, M is the residue of reaction of the ethyl acrylate group on the macromonomer with the acrylate group of the comonomer, and x, y and z are integers.

The resulting SA type TPE has a continuous polar polyacrylate backbone with pendant polystyrene groups providing a dispersed hydrocarbon domain. The SA type TPE usually contains from about 25 to about 50% macromonomer.

A representative macromonomer, CHEMLINK® 4500, is a 2-polystyryl ethyl methacrylate of the formula:

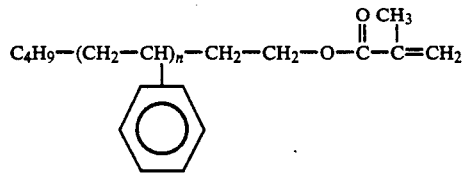

where n is an integer such that the molecular weight is about 13,000.

A SA type TPE containing about equal amount of CHEMLINK® 4500, 2-polystyryl ethyl methacrylate, and methyl acrylate was utilized in the compositions tested in Tables 2-8 which follow.

Plasticizers used in the present invention include:
dioctyl adipate (DOA);
acetyl triethyl citrate (ATEC);
triacetin (TA); and
trioctyl trimellitate (TOTM).

Polynitroaliphatic oxidizers are best suited for use with the TPEs and oxygenated plasticizer of the present invention. Particularly useful are polynitroalkyl derivatives in which the alkyl contains from 1-5 carbon atoms. Preferred oxidizers are trinitroethyl derivatives such as trinitroethylnitramines, trinitroethylcarbonates, trinitroethylformates, trinitroethylureas, and trinitroethylformals. Specific examples include:
trinitroethylorthocarbonate (TNEOC);
trinitroethylorthoformate (TNEOF);
bis(trinitroethyl)nitramine (BTNEN);
bis(trinitroethyl)carbonate (BTNEC);
trinitroethylformal (TNEF);
bis(trinitroethyl)urea (BTNEU);
tetrakis(trinitroethoxy)ethane (DITEFO);
trinitroethylnitroguanidine (TNENG); and
octanitro-diazaoctane (ONDO).

Processing the homogeneous energetic materials is accomplished in the following steps:

thermoplastic elastomer is melted at temperatures ranging from 100° C. to about 200° C. depending on the elastomer;

soluble plasticizer is mixed into the TPE as the mixture is cooled to a temperature of 90° C. to about 110° C.;

energetic solid is added in multiple increments with slight mechanical stirring as the TPE mixture is maintained at a temperature of 80° C. to about 100° C. The material is then cast.

The TPE generally constitutes about 3% to about 9% by weight and the plasticizer about 10–30% by weight of the total composition. Formulations containing about 65% to about 85% by weight of energetic solid have been found to work well.

The following Table 1 illustrates the impact, friction and electrostatic sensitivities of some energetic solids used in the present invention.

TABLE 1

Safety Test Data on Various Trinitroethyl Derivatives.

| | Impace 2½ Kg 50%, cm | ABL, lbs. 50% | Electrostatic Sensitivity, 0.25 J |
|---|---|---|---|
| ONDO | 9.0 | 402 | 10/10 NF |
| TNENG | 9.0 | 616 | 10/10 NF |
| BTNEU | 16.0 | 457 | 10/10 NF |
| TNEOF | 8.0 | 568 | 10/10 NF |

HMX = 14 cm

Trinitromethyl derivatives are known to be impact sensitive solids and TNEOF is no exception. The neat solid is more impact sensitive than HMX. However, when it is incorporated in the TPE/ATEC binder, substantial gain was evident in the impact sensitivities. They were raised to 22–72 cm (as shown in Table 2) depending on the solid level (85–70%). In comparison, samples containing conventional binders such as PEG/-TEGDN and GAP/GAP-$NO_2$ binder with solid loading at 62–65% were shown to have impact sensitivities in 9–12 cm range.

TABLE 2

Safety Test Data on TNEOF Based Propellants.

| Wt % TNEOF | Impact 2.5 Kg 50% cm | Friction, ABL 1000 lbs. | Electrostatic Sensitivity 0.25 J |
|---|---|---|---|
| 70 | 72 | 10/10 NF | 10/10 NF |
| 80 | 30 | 1/11 F | 10/10 NF |
| 85 | 22 | 10/10 NF | 10/10 NF |

The thermal analyses of neat TNEOF and TPE/A-TEC/TNEOF (80%) are shown in Table 3. The thermal decomposition of TNEOF appears to be the dominating mechanism for the propellant material since the temperatures for weight loss and peak exotherms are very similar between neat solid and propellant sample.

TABLE 3

Thermal Analyses of TNEOF and TNEOF Based Propellant Composites.

| | TNEOF[1] | TPE/ATEC[2]/TNEOF (80%) |
|---|---|---|
| TGA | | |
| Onset °C. | 152 | 150 |
| 1% Wt. loss, °C. | 162 | 156 |
| 10% Wt. loss, °C. | 182 | 170 |
| DSC | | |
| Onset °C. | 165 | 149 |
| Peak Exotherm, °C. | 205 | 210 |

[1]Shows an endotherm at 128° C., 129°
[2]B.P. for ATEC is 135° C. (1 mm Hg)

Tables 4 and 5 present the results of preliminary smallscale sensitivity tests (which include impact, electrostatic, friction, shock and slow cook-off tests) which were conducted on selected compositions. The results indicated that they have substantial gain in favorable sensitivity characteristics as compared to compositions made with the same solid ingredient by the conventional methods.

TABLE 4

Small Scale Sensitivity Test Results

| Sample Composition | Calculated Performance $I_{sp}$ | Density | Sensitivity |
|---|---|---|---|
| TPE/ATEC/TNEOF (80%) (homogeneous) | 245 sec | 1.65 g/cc | *Impact: 30 m with 2.5 kg *Mild cook-off *Small scale shock sensitivity: NO GO; 120 cards |
| PEG/TEGDN/TNEOF (62%) (single phase) | 244 sec | 1.62 g/cc | *DETONATION in slow cook-off |

TABLE 5

Safety Test Results

| Weight % TNEOF | Impact, cm 2.5 Kg | Friction, ABL 1000 lbs. | Electrostatic 0.25 J |
|---|---|---|---|
| 70 | 72 | 10/10 NF | 10/10 NF |
| 80 | 30 | 1/11 F | 10/10 NF |
| 85 | 22 | 10/10 NF | 10/10 NF |

Tables 6–8 provide calculated Specific Impulse and Density data for several formulations. Each table provides the Specific Impulse and Density for varying weight percentages of solid explosive and for binders containing different plasticizers. The binders for all formulations contain a 3:1 ratio of plasticizer to thermoplastic elastomer (TPE). The TPE used in all formulations of Tables 2–8 is a copolymer of polystyrene and polyacrylate. The plasticizers listed in the tables are: dioctyl adipate (DOA), acetyl triethyl citrate (ATEC), and triacetin (TA). The explosive solid of Table 6 is trinitroethylorthocarbonate (TNEOC). Tetrakis(trinitroethoxy)ethane (DITEFO) is the explosive solid of Table 7 and trinitroethylorthoformate (TNEOF) is the explosive solid of Table 8.

TABLE 6

Specific Impulse & Density for TNEOC Based Propellant Compositions

| Plasticizer Type | | Percent by Weight of the Oxidizer 78% | 80% | 82% | 84% |
|---|---|---|---|---|---|
| DOA | - sec. | 236.0 | 242.0 | 247.5 | 252.5 |
| | - g/cc | 1.5248 | 1.5488 | 1.5736 | 1.5991 |
| ATEC | - sec. | 244.7 | 248.8 | 252.4 | 255.4 |
| | - g/cc | 1.6068 | 1.6253 | 1.6444 | 1.6638 |

TABLE 6-continued

| Specific Impulse & Density for TNEOC Based Propellant Compositions | | | | | |
|---|---|---|---|---|---|
| Plasticizer | | Percent by Weight of the Oxidizer | | | |
| Type | | 78% | 80% | 82% | 84% |
| TA | - sec. | 246.1 | 249.8 | 253.1 | 255.7 |
| | - g/cc | 1.6167 | 1.6346 | 1.6529 | 1.6716 |
| Plasticizer/polymer = 3.0 | | | | | |

TABLE 7

| Specific Impulse & Density for DITEFO Based Propel-Propellant Compositions | | | | | |
|---|---|---|---|---|---|
| Plasticizer | | Percent by Weight of the Oxidizer | | | |
| Type | | 78% | 80% | 82% | 84% |
| DOA | - sec. | 228.4 | 234.7 | 240.6 | 246.1 |
| | - g/cc | 1.5204 | 1.5441 | 1.5686 | 1.5938 |
| ATEC | - sec. | 238.4 | 242.9 | 247.1 | 250.9 |
| | - g/cc | 1.6018 | 1.6201 | 1.6389 | 1.6581 |
| TA | - sec. | 240.1 | 244.3 | 248.1 | 251.6 |
| | - g/cc | 1.6117 | 1.6293 | 1.6474 | 1.6658 |
| Plasticizer/polymer = 3.0 | | | | | |

TABLE 8

| Specific Impulse & Density for TNEOF Based Propellant Compositions | | | | | |
|---|---|---|---|---|---|
| Plasticizer | | Percent by Weight of the Oxidizer | | | |
| Type | | 78% | 80% | 82% | 84% |
| DOA | - sec. | 232.3 | 238.6 | 244.2 | 249.6 |
| | - g/cc | 1.5513 | 1.5769 | 1.6033 | 1.6306 |
| ATEC | - sec. | 241.6 | 245.9 | 249.9 | 253.3 |
| | - g/cc | 1.6362 | 1.6563 | 1.6768 | 1.6979 |
| TA | - sec. | 243.2 | 247.2 | 250.8 | 253.9 |
| | - g/cc | 1.6465 | 1.6159 | 1.6857 | 1.706 |
| Plasticizer/polymer = 3.0 | | | | | |

Table 9 provides theoretical performance of a typical formulation of the present invention for explosive application as calculated by Kamlet's method. Performance characteristics are calculated for varying weight percentages of trinitroethylorthoformate (TNEOF) explosive solid. The binder consists of 3 parts by weight acetyl triethyl citrate (ATEC) to 1 part thermoplastic elastomer. A copolymer of polystyrene and polyacrylate was used as the thermoplastic elastomer.

TABLE 9

| Calculated Performance for Explosive Application | | | |
|---|---|---|---|
| TNEOF (wt %) | 80 | 84 | 85 |
| Detonation Pressure (Kbar) | 247 | 267 | 273 |
| Detonation Velocity (mm/u sec) | 7.72 | 7.97 | 8.03 |
| Cylinder Energy @6 mm (KJ/g) | 0.95 | 1.02 | 1.04 |
| Cylinder Energy @ 19 mm (KJ/g) | 1.21 | 1.3 | 1.32 |

Table 10 provides theoretical performance of a typical formulation of the present invention for gun propellant application as calculated by Kamlet's method. The theoretical performance of the following compositions are approximately 5 to 10% greater than state-of-the-art gun propellants such as LOVA gun propellant.

TABLE 10

| Calculated Performance For Gun Propellant Application | | | |
|---|---|---|---|
| TNEOF (wt %) | 80 | 82 | 84 |
| Mass impetus (J/g) | 1132 | 1140 | 1141 |

TABLE 10-continued

| Calculated Performance For Gun Propellant Application | | | |
|---|---|---|---|
| Flame temperature (°K.) | 3585 | 3684 | 3762 |

In summary the plasticized polar thermoplastic elastomer binder of the invention is able to dissolve the nitroaliphatic oxidizer at elevated temperature and cools to provide compositions with little or no crystallites. The energetic composition of the invention has low sensitivity with high combustion efficiency. The composition can be used as a propellant or an explosive. The solid levels depend on the performance requirements for different systems.

It is to be realized that only preferred embodiments of the invention have been described and that numerous substitutions, modifications and alterations are permissible without departing from the spirit and scope of the invention as defined in the following claims.

We claim:

1. A castable, insensitive energetic composition consisting essentially of a homogenous solution of 65 to 85% by weight of energetic oxidizer solids of a polynitroalkyl substituted compound in which each polinitroalkyl contains from 1-5 carbon atoms in a plasticized thermoplastic elastomer, the said plasticizer thereof being a $C_1$ to $C_{10}$ alkyl ester of an organic acid, said thermoplastic elastomer being a block copolymer containing both oleophilic hydrocarbon polymer segments and polar, oxygen containing polymer segments.

2. A composition according to claim 1 in which the polynitroalkyl compound is a member selected from the group consisting of (polynitroalkyl) substituted carbonates, formates, nitoramines, ureas, alkanes, guanidines and diazoalkanes.

3. A composition according to claim 1 in which the hydrocarbon segments of the elastomer are selected from saturated hydrocarbon polymer segments or unsaturated hydrocarbon polymer segments.

4. A composition according to claim 3 in which the hydrocarbon polymer segments are selected from polyethylene, polypropylene, polyisobutylene, polystyrene, polybutadiene or polyisoprene.

5. A composition according to claim 3 in which the polar segments are selected from polyester, polyether, polyurethane, polyvinyl acetate or polyacrylate.

6. A composition according to claim 5 in which the block copolymer is a polystyrene-polyacrylate block copolymer.

7. A composition according to claim 1 in which the oxidizer is a trinitroethyl substituted compound.

8. A composition according to claim 6 in which the polystyrene-polyacrylate block copolymer has a molecular weight from 500 to 50,000 and has a comb-like configuration.

9. A composition according to claim 8 in which the block copolymer comprises the residue of the polymerization of an acrylate terminated polystyrene macromonomer of the formula:

$$(St)_n-O-\overset{\overset{\displaystyle O}{\|}}{C}-R^1=CH_2$$

where $(St)_n$ represents a polystyrene segment and $R^1$ is H or alkyl of 1-6 carbon atoms; and an acrylate segment of a monomer of the formula:

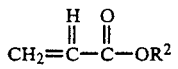

where $R_2$ is a alkyl of 1–6 carbon atoms.

10. A composition according to claim 9 in which the thermoplastic elastomer has a polar polyacrylate backbone with polystyrene segments pendant therefrom.

11. A composition according to claim 10 in which $R^1$ and $R^2$ are ethyl.

12. A composition according to claim 1 formed by dissolving said plasticizer in heated thermoplastic elastomer, dissolving the oxidizer in the plasticizer elastomer and slowly cooling the solution to form a homogenous, single phase composition substantially absent crystalline solid phase.

13. A composition according to claim 1 containing 3–9 percent by weight of said thermoplastic elastomer, 10–30 percent by weight of plasticizer and 65–85 percent by weight of oxidizer.

14. A composition according to claim 1, wherein the amount of plasticizer is from 50–75% by weight of the plasticized thermoplastic elastomer binder.

15. A composition according to claim 2 in which the oxidizer is selected from the group consisting of tetrakis(trinitroethyl)orthocarbonate, tris(trinitroethyl)orthoformate, bis(trinitroethyl)nitramine, bis(trinitroethyl)carbonate, bis(trinitroethyl)formal, bis(trinitroethyl)urea, tetrakis(trinitroethoxy)ethane, trinitroethylnitroguanidine, and octanitrodiazaoctane.

16. A composition according to claim 1 in which the plasticizer is selected from dioctyl adipate, acetyl triethyl citrate, triacetin or trioctyl trimellitate.

* * * * *